United States Patent [19]

Levy

[11] 4,420,061

[45] Dec. 13, 1983

[54] PENTAGONAL SPEAKER ENCLOSURE WITH A DOWNWARD DIRECTED DYNAMIC DAMPING SYSTEM

[76] Inventor: Michael Levy, 160-15 Powells Cove Blvd., Beechhurst, N.Y. 11357

[21] Appl. No.: 203,349

[22] Filed: Nov. 3, 1980

[51] Int. Cl.[3] ..... H04R 7/24; H04R 1/28

[52] U.S. Cl. ..... 181/166; 181/163; 181/144; 179/146 E

[58] Field of Search ..... 179/1 E, 146 E; 181/155, 156, 163, 166, 144

[56] References Cited

U.S. PATENT DOCUMENTS 1,988,250 1/1935 Olson ..... 181/163 X 4,301,332 11/1981 Dusanek ..... 179/1 E

*Primary Examiner*—Stafford D. Schreyer

*Attorney, Agent, or Firm*—Kevin Redmond

[57] ABSTRACT

A speaker enclosure with a pentagonal cross section and sloping sides contains a dynamic damping system located in the lower portion of the enclosure. Speakers mounted in the side walls are always positioned opposite a corner to prevent the production of standing waves. The rearward projection from the speaker and reflections from the walls are directed downward to the dynamic damping system, eliminating the absorptive padding used in prior systems and its inherent loss.

9 Claims, 5 Drawing Figures

PENTAGONAL SPEAKER ENCLOSURE WITH A DOWNWARD DIRECTED DYNAMIC DAMPING SYSTEM

BACKGROUND

1. Field

The present invention relates to loud speaker enclosures and, in particular, to those containing internal damping systems.

2. Prior Art

A typical prior art speaker enclosure is shown in FIG. 1. FIG. 1A illustrates the front elevation view of the prior art speaker comprising an enclosure 101 and a speaker port 102. FIG. 1B illustrates an internal side view of the speaker enclosure shown in FIG. 1A, comprising the enclosure 101, a speaker 106, and internal sound absorptive padding 103.

The speaker is mounted on the front side panel 108 and positioned to direct the sound outward of the port 102. Padding 103 is distributed about the top 109, bottom 110 and back of the internal walls of the enclosure 101.

In the operation of the enclosure, the speaker 106 produces forward and rearward projected waves. The rearward projected waves, which are indicated by directional arrows 104, strike the rear of the cabinet 107 and are reflected back toward the front of the cabinet 108, as indicated by directional arrows 105. Such waves can continue to reflect back and forth between the walls to produce standing waves which degrade the quality of the reproduced sound. Typically, padding 103 must be added to damp these waves; however, the padding tends to reduce the total sound output which can be obtained from the system.

In some prior art speaker designs, tuning was provided by a passive speaker cone mounted in one of the side panels in a manner similar to speaker 106 shown in FIG. 1B. The cone is not driven by the usual magnetic coils, but is simply a baffle free to float and absorb waves impinging upon it. In some instances, the cone is weighted to provide tuning. Unfortunately, when strong, low frequency sounds such as subsonic sounds, impinge upon the speaker, they drive the cone to a bottoming or limit position which tends to loosen the weight and tear the cone. The active speaker can also be damaged in this design when powerful subsonic frequencies pass through the system by hitting the voice coil against the magnet or through tortional stress.

SUMMARY

An object of the present invention is to provide a speaker enclosure which does not produce standing wave and which eliminates or greatly reduces the requirement for absorptive padding to attenuate standing waves.

An object of the present invention is to provide a unique damping system which aids in reducing or eliminating the requirement for absorptive padding.

An object of the present invention is to provide a damping system designed to absorb strong subsonic waves without damage to the active speaker or passive cone.

To eliminate standing waves in the present invention, the speaker enclosure is structured to form a pentagon when viewed in horizontal cross section. The side panels of the enclosure slope inward as they rise towards the top of the cabinet. Speakers are mounted in the side panels and are accordingly positioned to project orthogonally with respect to the side panels. The lower portion of the cabinet contains a raised platform upon which is mounted a novel dynamic damping system.

In this system, the rearward projected sound waves from the speaker are always directed towards a corner formed on the opposite side of the cabinet because of the pentagonal cross section. The rearward projected waves and reflected waves are directed downward towards the dynamic damping system because of the sloping side panels. This design prevents the production of standing waves. Rearward projected waves are effectively diffused by the panels and absorbed by the damping system.

DETAILED DESCRIPTION OF THE INVENTION

Figure 1A:
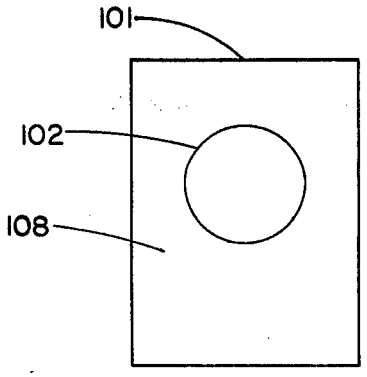
PRIOR ART Fig. 1A
FIG. 1A is a front elevation view of a prior art speaker enclosure.
Figure 1B:
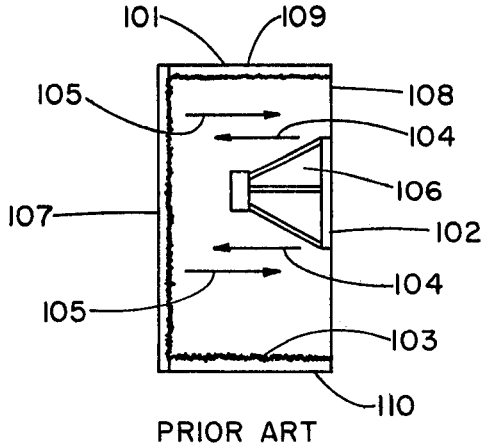
PRIOR ART Fig. 1B
FIG. 1B is a cross sectional view of the side of the speaker enclosure of FIG. 1.
Figure 2A:
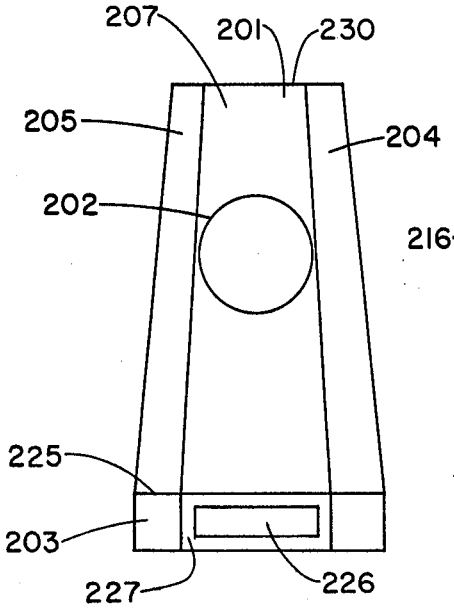
FIG. 2A is a front elevation view of the speaker enclosure embodying the present invention.

FIG. 2A is a front elevation view of an enclosure 201, comprising side panels 204, 205, and 207, base 203, speaker port 202 and external damper port 226.

Figure 2B:
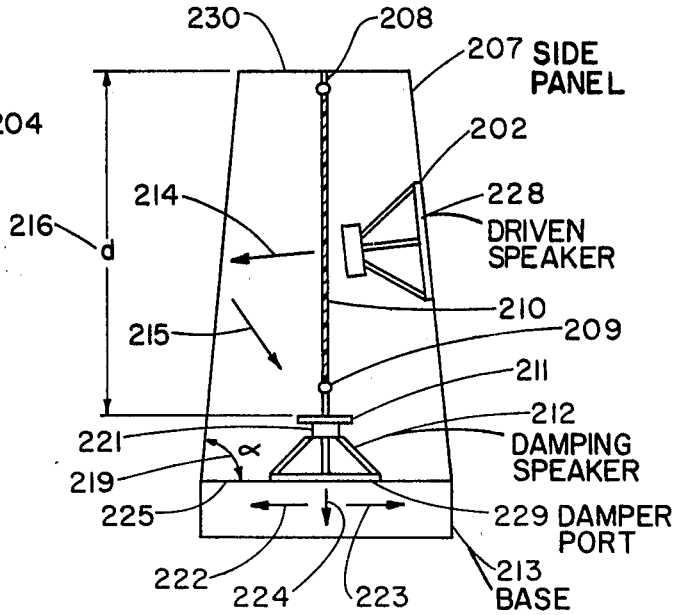
FIG. 2B is a cross sectional view of the side of the speaker enclosure of FIG. 2A.
Figure 2C:
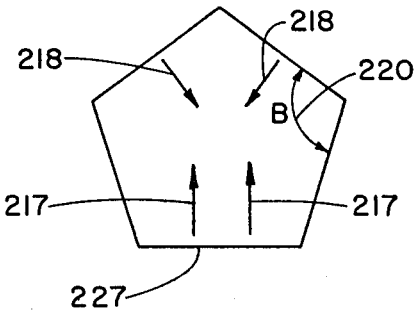
FIG. 2C is a bottom view of the speaker enclosure of FIG. 2A.

FIG. 2C is a bottom view of the base in FIG. 2A showing the pentagonal cross section of the enclosure. The side 227 of the base 203 which faces forward is indicated in both FIGS. 2A and 2C. The side panels are planar and are set to slope inward as they rise towards the top 230, retaining a pentagonal cross section throughout.

FIG. 2B is a cross sectional view of the side of the speaker enclosure shown in 2A showing the internal components of the enclosure including a driver speaker 228, an elastic band 210 and upper mounting terminal for the elastic band 208, a lower mounting terminal for the elastic band 209, a weight 211, a speaker 212 with the drive mechanism removed, and a platform 225 havng an internal damper port 229.

The speaker 228 is mounted at the port 202 in side panel 207. The upper mounting terminal for the elastic band 209 is connected to the top of the enclosure while the lower mounting terminal 209 is connected to the weight 211. The weight in turn is connected to the cone 221 of speaker 212. The platform 225 is mounted horizontally across the top of the base 203 and supports the speaker 228 at the port 229. The side panels are connected together at their edges and connected to the base and enclosure top at their lower and upper ends respectively. The side panels form an acute angle $\alpha$ 219 with the horizontal plane defining their inward slope towards the top of the enclosure. As illustrated in FIG. 2C, the side panels form a pentagon in cross section with an obtuse angle B 220 between panels.

In the operation of the enclosure shown in FIG. 2 the speaker 228 produces the normal forward sound wave which passes through port 202 to the listener. It also produces a rearward projected wave 214, which is reflected off a side panel to produce a wave 215. It can be seen that wave 215 is directed towards the damping speaker at the lower portion of the enclosure. Damping speaker 229 absorbs the energy produced by the wave 215 by movement of the cone which is opposed by the weight and the restraining force of the elastic band 210. Outward projected sounds from the speaker 212 pass through a port 229 in the platform 225 and downward towards the floor as shown by directional arrow 224. Sound waves which have been projected downward in the direction of 224 which continue to propagate, do so in a lateral direction shown by arrows 222 and 223. Such sound waves are projected out along the floor through ports such as port 226 shown in FIG. 2A. The dispersal of the sound in all directions by means of multiple ports similar to port 226 adds realism to the sound produced, as the sound produced by a musical instrument is similarly projected in all directions.

Elastic band 210 is designed to exhibit a linear restraining characteristic, whereby the force produced by it is linearly proportional to the displacement. The length of this band is cut and adjusted to support the weight 211 and hold the speaker at its normal rest position indicated by dimension d, 216 as shown in FIG. 2B.

The downward direction of the damping cone and the elastic support for this cone offers a number of advantages. Prior art systems position the damping cone on one of the side panels where it is difficult to direct all the standing waves. In the present invention, it is possible to direct all such waves downward towards the damping speaker by means of the sloping side walls. The side panel mounting of prior art damping cones required that the support for the speaker cone referred to as a spider be a rigid structure. This limits the excursion of the cone and tends to induce bottoming.

In the present invention the speaker is supported by the elastic band, making it possible to make the spider of more compliant material. In addition, the speaker cone may carry a heavier than usual weight because this weight is supported by the elastic band.

In the operation of the damper speaker, the lower frequencies are dissipated by the movement of the damping cone and weight against the elastic band. The higher frequencies beyond the response of the damping cone are absorbed by the material in the cone itself.

The elastic band is designed to hold the damping cone at its neutral position, from which it may be driven. The restoring force to the neutral position is proportional to the displacement, making the damping cone a relatively distortion free element in the system.

Subsonic sounds are effectively damped by this system without damage to the cone. In prior art system there is no restraining band connected to the cone. The subsonic sound cause the speaker to go into excursions which drive it to its limits or bottoming position. This action tends to tear the weight from the cone and otherwise damage the cone.

In the present invention a large excursion of the cone is resisted with a proportionately large restraining force provided by the elastic band. In this way, the cone is prevented from bottoming due to large excursions produced by subsonic sounds, but the damping cone is moved by these sounds which results in their dissipation. The dissipation also prevents damage to the driver cones by absorbing the subsonic sound waves while providing damping to the speaker to prevent it from damage due to bottoming of the voice coil against the magnet structure.

The damping produced by the speaker 212 reduces or eliminates the need for padding required in prior art system.

Referring now to FIG. 2C, sound waves which are projected rearward by the speaker are indicated by arrows 217. These waves impinge upon walls at a corner and are then reflected in the directions shown by directional arrows 218. This mode of reflection, which diffuses rearward projected waves, remains constant regardless of the panel in which the speaker is placed. This feature prevents the production of standing wave because, unlike the prior art, there are no parallel panels in any direction from any speaker mounting position.

Having described my invention, I claim:

1. A speaker enclosure cabinet, comprising:

(a) five substantially similar side panels, one of which contains a first speaker port passing through the face of the panel, each panel having two opposite edges designated as side edges of the panel and two other opposite edges, one of which is designated the top edge and the other the bottom edge, (b) means for connecting the side panels at their edges with each panel being connected at each of its side edges to a separate, adjacent panel at one of the adjacent panels side edge, all panels being connected in this manner at both side edges to form a partly enclosed volume within the panels, (c) a base having a height less than that of the side panels, the base having a plurality of substantially similar sides, each base side having opposite edges designated base side edges and two opposite edges with one designated the base top edge and the other the base bottom edge, the base side edges being connected to an edge of a separate adjacent base side, all base sides being connected in this manner to partially enclose a volume within the base sides, the base containing an external damper port in one side, the base top edges supporting and being connected to the bottom edges of the side panels, (d) a top panel, said top panel being positioned to cover and secured to all the top edges of the side panels to further enclose the volume between the side panels, (e) a speaker mounted within the cabinet at the first port by being secured to the panel containing the first port, (f) a raised platform within the cabinet positioned in the horizontal plane at the top of the base top edges, and said platform being secured thereto for support on the base, the platform containing a second speaker port, and (g) a resilient baffle for damping being placed across the second port and being secured to the platform.

2. An enclosure as claimed in claim 1, further comprising a weight attached to the baffle and wherein the baffle is a damping speaker cone.

3. An enclosure as claimed in claim 2, wherein the resiliency of the damping speaker cone is linear, in that the force of restoration to a position of rest for the cone is directly proportional to the displacement from the position of rest.

4. An enclosure as claimed in claim 3, wherein the resiliency of the damping speaker cone is augmented by means of an elastic band which is attached at one end to the top panel of the cabinet and at the other end to the weight, the elastic band being placed in tension to support the weight and to maintain the damping speaker cone at zero displacement from the rest position prior to the absorption of downward directed waves.

5. An enclosure as claimed in claim 1, wherein the five side panels form a pentagon in horizontal cross section.

6. An enclosure as claimed in claim 5, wherein the side panel surfaces are planar, the lower portion being wider than the top, causing the side walls to slope inward towards the top.

7. An enclosure as claimed in claim 6, wherein the speaker is mounted flush to the side wall and positioned to direct rearward sound waves downward towards the baffle for damping.

8. An enclosure as claimed in claim 7, further comprising a weight attached to the baffle and wherein the baffle is a damping speaker cone, the force of restoration to a position of rest for the cone is directly proportional to the displacement from the position of rest, and the resiliency of the damping cone is augmented by means of an elastic band which is attached at one end to the top panel of the cabinet and at the other end to the weight, the elastic band being placed in tension to support the weight and to maintain the damping speaker cone at zero displacement from the rest position prior to the absorption of the downward directed waves.

9. A passive damper for subsonic waves comprising:

(a) a downward facing passive speaker cone, (b) a weight attached to the speaker cone, (c) an elastic band attached at one end to the weight and extending upwards from the weight, (d) means for supporting the opposite end of the elastic band at a distance above the speaker cone to support the band which in turn supports the weight and speaker cone in a neutral position and exerts a restraining force on the motion of the speaker cone in the downward direction proportional to the displacement of the speaker cone from the neutral position to prevent the speaker cone from bottoming and thus avoid damaging the speaker cone, where the speaker cone is subject to subsonic waves.

* * * * *